United States Patent [19]

Parker et al.

[11] Patent Number: 4,472,135

[45] Date of Patent: Sep. 18, 1984

[54] FLAME COLORING DEVICE

[75] Inventors: Robert Parker, Alamo; Thomas D. Ratzlaff; Donald A. Micheletti, both of Menlo Park, all of Calif.

[73] Assignee: Raychem Corporation, Menlo Park, Calif.

[21] Appl. No.: 351,676

[22] Filed: Feb. 23, 1982

[51] Int. Cl.[3] ..... F23Q 2/32

[52] U.S. Cl. ..... 431/126; 356/315

[58] Field of Search ..... 431/4, 126, 347, 350, 431/354; 356/315

[56] References Cited

U.S. PATENT DOCUMENTS

| | | | |
|---|---|---|---|
| 808,513 | 12/1905 | Cox | 431/126 |
| 1,829,001 | 10/1931 | Geromanos | 356/315 |
| 2,270,443 | 1/1942 | Teaneck . | |
| 2,809,101 | 10/1957 | Mitchell | 431/126 |
| 3,187,523 | 6/1965 | Kilbourn | 431/347 |
| 3,385,647 | 5/1968 | Miller et al. | 431/4 |
| 3,468,615 | 9/1969 | Carey | 431/126 |
| 3,504,976 | 4/1970 | Gilbert, Jr. | 431/126 |
| 3,816,062 | 6/1974 | Bouvier | 431/355 |

FOREIGN PATENT DOCUMENTS

| | | | |
|---|---|---|---|
| 7242287 | 6/1974 | France . | |
| 12742 | of 1902 | United Kingdom | 431/126 |
| 170138 | 10/1921 | United Kingdom . | |
| 216968 | 6/1924 | United Kingdom . | |
| 988779 | 4/1965 | United Kingdom . | |
| 988799 | 4/1965 | United Kingdom . | |
| 1272751 | 5/1972 | United Kingdom . | |
| 2049912 | 12/1980 | United Kingdom . | |

OTHER PUBLICATIONS

U.K. Search Report.

*Primary Examiner*—Carroll B. Dority, Jr.

*Attorney, Agent, or Firm*—Herbert G. Burkard; T. Gene Dillahunty; Dennis E. Kovach

[57] ABSTRACT

A flame coloring device makes a flame, such as a flame from a propane burner, visible even when the burner is used outdoors or in a bright environment. The device includes a carrier adapted for placement on the burner barrel and a solid colorant emitter such as sodium chloride supported by the carrier. When the carrier and colorant emitter are heated by the burner flame, the emitter emits a material that provides visible light, thereby defining the flame.

16 Claims, 3 Drawing Figures

FLAME COLORING DEVICE

BACKGROUND

The present invention relates to techniques and devices for rendering a flame visible.

Attempts have been made to add various materials to fuel in order to render a flame visible for safety. However, this technique is impractical for compressed liquids and gases due to the difficulty in adding material to these fuels. Furthermore, it is desirable to be able to burn the fuel without an additive present. Once the fuel has the additive included, the option of burning the fuel without the additive is unavailable.

Moreover, the addition of even small amounts of additive can degrade the performance of a burner by clogging the small orifice where the fuel is expelled. In addition, some additives can cause smoke.

What is needed then is a safe, inexpensive, versatile, and reliable device that renders a flame visible and that can easily be used with existing burners with a variety of fuels.

SUMMARY

The present invention is directed to an article with these features. The article comprises two elements, a colorant emitter and a substrate or carrier that supports the colorant emitter. The colorant emitter can be a substance that is capable of emitting a material that provides visible light when the colorant emitter is placed in the flame. A suitable colorant emitter is a sodium salt such as sodium chloride, which when heated sufficiently ionizes to produce sodium ions which emit a visible yellow light, which can be easily seen against a blue sky or other brightly lit background.

The substrate which carries the ion emitter is adapted for placement on a burner barrel with an emitter portion of the substrate extending into the flame. The substrate constitutes a material that is mechanically and thermally stable even when placed in a very hot flame.

A preferred substrate is stainless steel mesh formed into a generally cylindrical shape for placement on a burner barrel, either inside the burner barrel or on the outside of the burner barrel, with an interference fit therebetween. An emitting portion of the substrate which has the ion emitter thereon is within or proximate to the flame.

It is important that the colorant emitter be at a temperature approaching the flame temperature. Thus, conductive losses from the substrate, and particularly the emitter portion of the substrate, are minimized. This can be accomplished by using a substrate that is longitudinally fluted to minimize contact between the substrate and the barrel. In addition, the substrate can have means for decreasing heat conduction from the emitting portion to the remainder of the substrate. Such means can be cut out portions separating the emitting portion of the substrate from the remainder of the substrate.

This flame coloring device is versatile, reliable, and long-lived, having been demonstrated to color flames for times in excess of five hours. It is inexpensive and disposable, and renders a dangerous flame visible so that it can be used in safety.

DRAWINGS

These and other features, aspects, and advantages of the present invention will become better understood with reference to the following description, appended claims, and accompanying drawings where:

DESCRIPTION

Figure 1:
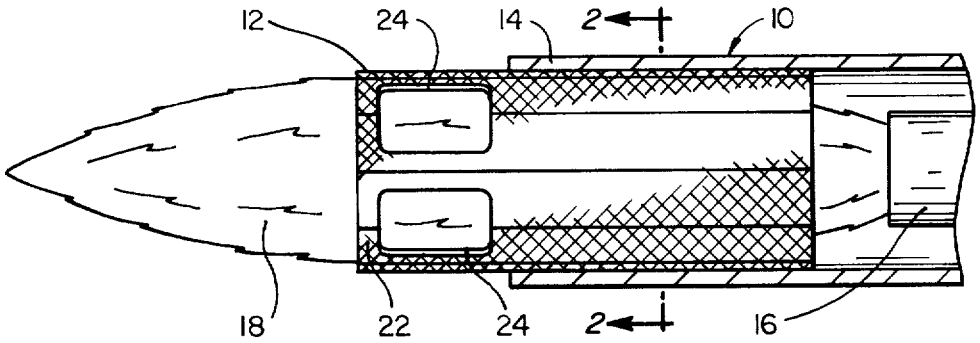
FIG. 1 shows in longitudinal section a burner equipped with a flame coloring device according to the present invention, the flame coloring device being mounted within the burner barrel.
Figure 2:
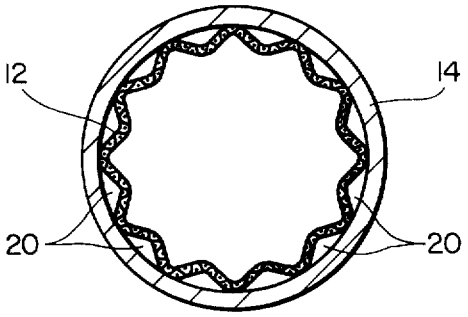
FIG. 2 is a longitudinal sectional view of the burner and flame coloring device of FIG. 1 taken at line 2—2 in FIG. 1.

With reference to the figures, a burner 10 is provided with a flame coloring device 12 according to the present invention. The device 12 can be used with a variety of burners for a variety of fuels, including liquid and gaseous fuels such as propane, acetylene, butane, methane, gasoline, and other hydrocarbon fuels. These fuels generally have a flame temperature in the order of 4,000° F. to 4,500° F.

The burner 10 has a cylindrical barrel 14, a nozzle 16 for the fuel, and when operating, produces a flame 18 that is conical within the barrel 14 and generally cylindrical beyond the barrel.

The burner barrel 14 can be of a material such as brass or stainless steel. Barrels typically have outer diameters in the order from about one half to about two inches.

The device 12 comprises a carrier or substrate which carries a colorant emitter. The colorant emitter is a solid material that is capable of emitting visible light when placed in the flame. A suitable colorant emitter is one that when heated to the flame temperature, emits ions that emit visible light. Thus preferably the colorant emitter produces visible light at temperatures less than about 4,000° F. At such elevated temperatures the solid emitter may become molten but in such event the substrate employed should be such that the molten emitter is retained on the substrate.

Exemplary materials that can color a flame are potassium, rubidium, and cesium compounds (violet); copper chloride, copper bromide, lead, arsenic, and selenium compounds (blues); barium, antimony, and zinc compounds (greens); lithium, strontium, and calcium compounds (reds); and sodium compounds (yellow). A listing of flame colorations can be found in the Handbook of Chemistry and Physics, 47th Edition, The Chemical Rubber Company, page D-59, which is incorporated herein by this reference.

Preferred materials are sodium, lithium, and copper salts, with the sodium salts being most preferred because they provide a highly visible yellow color. Yellow is a desirable color when working out of doors, because it contrasts with the blue sky. The preferred sodium compound is sodium chloride.

Sodium salts and other salts when heated ionize, in the case of sodium salts to give off sodium ions. Thermal excitation of the sodium ions produces emission of a bright yellow light.

The substrate carries the colorant emitter. Because the substrate is in close proximity, and preferably within the flame, it needs to be thermally and mechanically stable at the temperature of the flame. Suitable materials for the substrate are stainless steel, carbon, low carbon steel, Hastelloy TM, titanium, tungston, and molybdenum. Stainless steel is the preferred material because of its mechanical strength at high temperatures, its relatively poor thermal heat transfer characteristics, easy formability, and oxidation resistance.

Figure 3:
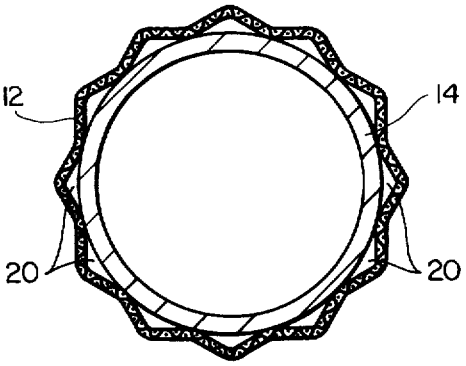
FIG. 3 is a view similar to that of FIG. 2 showing a burner equipped with a flame coloring device on the exterior of a burner barrel.

Preferably the substrate is generally cylindrical in shape as shown in the figures. The term cylindrical as used herein includes tubular substrates and substrates which are not necessarily circular in cross-section but which can be of other suitable configurations such as oval, hexagonal or the like to conform to the shape of the barrel. Preferably the substrate has a diameter that provides an interference fit with the barrel 14 of the burner 10. The device 12 can be placed on the inside of the barrel 14 as shown in FIG. 1, in which case the outer diameter of the device 12 should be about 0.03 inch greater than the inside diameter of the barrel 14. Alternatively, as shown in FIG. 3, the device 12 can be placed on the outside of the barrel 14, in which case the inside diameter of the device 12 should be about 0.03 inch smaller than the outside diameter of the barrel 14. Placing the device on the outside of the barrel is particularly advantageous when the barrel has a relatively small inside diameter. In either case, an interference fit is provided between the device 12 and the barrel 14 on the burner 10. If desired, means other than an interference fit can be provided to secure the substrate to the barrel of the burner. The substrate can, for example, be clamped or bolted to the barrel.

An advantage of having a cylindrical flame coloring device is that the entire periphery of the flame is colored, while the flame itself remains relatively undisturbed.

Preferably the substrate is in a form which provides a large surface area with a small volume of material, and thus preferably is mesh-like. A mesh configuration allows the substrate to be quickly heated, yet provides a large surface area from which a colorant can be emitted into the flame. Further, mesh allows oxygen to reach the flame for burning of the fuel. Another advantage of mesh is that it has a relatively low thermal conductivity, and thus dissipates only small amounts of heat from the flame. Further, mesh is easy to form.

To form the mesh into a cylinder, it is rolled into the desired diameter, from about one-half to about two inches, and the ends are spot-welded together.

The mesh size can be from about 40 to about 80, with smaller mesh sizes having an advantage that small wires can be used, and thus little heat is lost through conduction.

It is important that the substrate be a poor conductor of heat. This allows the portion of the substrate in contact with the flame to be heated to a high temperature to maximize the amount of ions emitting visible light to maximize the intensity of the light. Thus, the use of stainless steel, which is a relatively poor thermal conductor, and a mesh design which minimizes heat losses by thermal conduction, is desirable.

The substrate preferably is fluted, i.e. has a plurality of spaced apart longitudinal or axial grooves 20. Alternatively, the grooves can be circumferential. In this configuration, the surface area of the contact between the barrel 14 and the device 12 is substantially reduced as compared to a device 12 that is perfectly cylindrical. Thus, when reference is made to the device 12 being generally cylindrical, there is also included a device having such a fluted structure.

In the version of the invention shown in FIG. 1, the device extends beyond the end of the burner by about ½ inch and extends into the barrel 14 for a distance of about 1½ inches. However, it is possible for the device to not extend beyond the end of the barrel, as long as the colorant emitter can be heated to a sufficiently high temperature to provide a visible flame.

The device 12 includes an end portion or emitting portion 22 that becomes red hot in a flame. To maximize the temperature of the emitting portion, means are provided for decreasing the heat conduction from the emitting portion to the remainder of the device. Such means can be cut-outs or spaces 24 in the mesh. These spaces 24 minimize heat conduction from the emitting portion to the remainder of the device.

The colorant emitter can be placed on the substrate by a variety of techniques. For example, the substrate can be dipped into molten color emitter, i.e. molten NaCl. Alternatively, in the case of a soluble colorant emitter such as sodium chloride, a concentrated aqueous solution of the colorant can be allowed to dry on the substrate. Alternatively, the colorant emitter can be incorporated into a resin such as epoxy resin, which can be applied to the substrate, and then cured resin can be burned off.

The flame coloring device of the present invention has significant advantages. Because of the low heat conductivity of the substrate, and the separation of the emitting portion from the remainder of the device, the colorant emitter becomes hot very quickly. Thus, the flame becomes visible very quickly, in the order of seconds.

Further, the device is easy to use. It is inexpensive, simple to form, and minimizes interference with the flame. No complicated attachment mechanism is required to secure the device to a burner.

Most surprisingly, the device provides a colored flame for many hours, in excess of five hours.

Another advantage of the present invention is that the fuel itself is unaffected. Thus, the user has a choice of using the device or not using the device.

Further, the device has no moving parts, and thus is dependable and requires no maintenance.

The present invention has been described in considerable detail with reference to certain preferred versions thereof. However, other versions are possible. For example, multi-colored flames can be made by placing more than one type of colorant emitter on the carrier. Therefore the spirit and scope of the appended claims should not be limited to the description of the preferred versions contained herein.

What is claimed is:

1. An article for use with a burner having a cylindrical barrel for causing a burner flame to be visible, comprising:

(a) a cylindrical substrate constituted of stainless steel wire mesh, a diameter of the substrate being such that the substrate can be held on the burner barrel by an interference fit with an emitting portion of the substrate extending into the flame, the mesh having open portions between the emitting portion and the remainder of the substrate, the substrate being longitudinally fluted; and (b) a solid colorant emitter carried by the substrate at least on the emitting portion thereof, the colorant emitter being capable of emitting a material that provides visible light when the colorant emitter is heated by the flame, said colorant emitter being capable of providing visible light at temperatures less than about 4,000° F.

2. The article of claim 1 in which the colorant emitter is a sodium salt.

3. The article of claim 2 in which the colorant emitter is sodium chloride.

4. The article of claim 1 in which the substrate is adapted for placement within the barrel.

5. The article of claim 1 in which the substrate is adapted for placement on the outside of the barrel.

6. The article of claim 1 in which the substrate is constituted of stainless steel.

7. The article of claim 1 in which the emitting portion extends beyond the end of the barrel.

8. The article of claim 1 in which the substrate has a diameter of from about one half to about two inches.

9. A burner capable of producing a visible flame comprising:

(a) a cylindrical barrel;

(b) a cylindrical substrate constituted of wire mesh held on the burner barrel by an inteference fit with an emitting portion of the substrate extending into the flame, the mesh having open portions between the emitting portion and the remainder of the substrate, the substrate being longitudinally fluted; and (c) a solid colorant emitter carried by the substrate at least at the emitting portion thereof, the colorant emitter being capable of emitting a material that provides visible light when the colorant emitter is heated by the flame, said colorant emitter being capable of providing visible light at temperatures less than 4,000° F.

10. The burner of claim 9 in which the colorant emitter is a sodium salt.

11. The burner of claim 10 in which the colorant emitter is sodium chloride.

12. The burner of claim 9 in which the substrate is within the barrel.

13. The burner of claim 9 in which the substrate is on the outside of the barrel.

14. The burner of claim 9 in which the substrate is constituted of stainless steel.

15. The burner of claim 9 in which the emitting portion extends beyond the end of the barrel.

16. The burner of claim 9 in which the substrate has a diameter of from about one half to about two inches.

* * * * *

UNITED STATES PATENT AND TRADEMARK OFFICE

CERTIFICATE OF CORRECTION

PATENT NO. :4,472,135

DATED : September 18, 1984

INVENTOR(S) : Robert Parker et al.

It is certified that error appears in the above-identified patent and that said Letters Patent are hereby corrected as shown below:

Claim 1, line 4, delete "stainless steel".

Signed and Sealed this

*Fourth* Day of *March 1986*

[SEAL]

*Attest:*

DONALD J. QUIGG

*Attesting Officer*

*Commissioner of Patents and Trademarks*